United States Patent [19]

Smith et al.

[11] 4,416,374

[45] Nov. 22, 1983

[54] NEST AND STACK CONTAINER

[75] Inventors: Rush B. Smith, Philadelphia; Pasquale C. Daloisio, New Hope, both of Pa.

[73] Assignee: Pennsylvania Pacific Corporation, Warminster, Pa.

[21] Appl. No.: 368,917

[22] Filed: Apr. 16, 1982

[51] Int. Cl.[3] ..... B65D 21/04

[52] U.S. Cl. ..... 206/507; 220/1.5; 206/518

[58] Field of Search ..... 206/505, 506, 507, 518; 220/1.5

[56] References Cited

U.S. PATENT DOCUMENTS

| | | | |
|---|---|---|---|
| 2,774,511 | 12/1956 | Menkin | 206/507 |
| 3,326,410 | 6/1967 | Asenbauer | 206/507 |
| 4,280,640 | 7/1981 | Daloisio | 220/1.5 |
| 4,316,540 | 2/1982 | Lapham | 206/518 |

FOREIGN PATENT DOCUMENTS

| | | | |
|---|---|---|---|
| 2305356 | 10/1976 | France | 206/507 |
| 2314869 | 1/1977 | France | 206/507 |

*Primary Examiner*—George E. Lowrance
*Attorney, Agent, or Firm*—John F. A. Earley

[57] ABSTRACT

A nest-or-stack, lidless, open-stacking container for handling and storage of bulk material such as food products features a seamless, one piece plastic construction with channels formed into the bottom to permit the use of a forklift truck for moving, lifting and stacking of the container, and with stacking surfaces for stacking filled containers and nesting stop surfaces for nesting empty containers.

2 Claims, 8 Drawing Figures

NEST AND STACK CONTAINER

BACKGROUND OF THE INVENTION

1. Field of the Invention

The present invention pertains to lidless, durable, transportable containers which may be nested when empty and stacked when filled, made of plastic, for handling bulk materials such as liquids and powders, and which are adapted to be moved, lifted and stacked by means of a forklift truck or pallet jack without requiring the use of a pallet.

2. Description of the Prior Art

Prior art transportable containers for use in food processing and preparation plants with bulk materials such as liquids and powders like abrasives, sugar, Chicklet chewing gum and so on are rather large, one such container, as described in U.S. Pat. No. 4,280,640, being about 45 inches high, 39 inches wide, and 40 inches deep. The handling and lifting of such containers requires the use of a forklift truck.

A problem with such containers is that they need lids for use as stacking bases when stacking of the containers is desired or required. The lids are heavy and comprise a substantial part, approximating half of the cost to the user of the containers. Because they are expensive it is the practice for the containers to be used over and over again, being nested for economy of space when stored or returned to the bulk material supplier for refilling. This necessitates separate storage or shipping of the lids which, as a result, may become lost or otherwise become unavailable when needed.

There is, therefore, a demand or a need for a container which does not need a lid as a stacking base when stacking is desired or required, thereby enabling users to save the cost of lids, and additionally, to effect a desirable reduction in the weight of the containers. There is a need also for such a container that is made of plastic, may be handled directly by a forklift truck, is durable, and is adapted to be nested for economy of space for storage and shipping when empty.

SUMMARY OF THE INVENTION

An object of the invention is to provide a durable bulk container that may be nested when empty and stacked when filled, and which does not require a lid for stacking.

Another object is to provide such a container that may be moved and lifted by a forklift truck.

Another object of the invention is to provide such a container that is molded of plastic in seamless, one-piece construction.

A further object of the invention is to provide such a container with molded-in nesting stops.

In accomplishing these and other objectives of the invention, there is provided a container that is molded of FDA approved polyethylene in seamless, one-piece construction, channels being formed into the bottom of the container for receiving the tines of a forklift truck and stacking lugs being molded into an upper portion of the container for lidless open stacking while in one position, said stacking lugs being inoperative when the containers are in another position. The invention features a configuration of the container and such placement of the stacking lugs that a plurality of containers may be nested for facilitating the economical return of empty containers by the user for refilling simply by rotating each stacked container through an angle of 180° relative to the container beneath it. The invention further features tapered sides for the containers for economical nesting, and molded-in nesting stops for predetermining the relative positions of the containers when nested and for easy unnesting. Other features include a container roll-over lip for strength and a 5/16th inch wall thickness for durability.

DESCRIPTION OF THE PREFERRED EMBODIMENT

Figure 1:
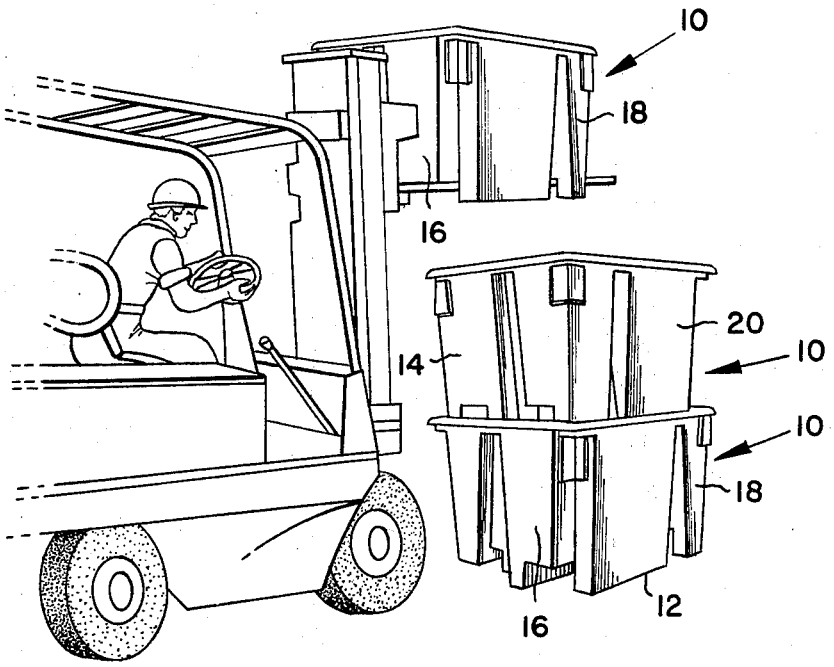
FIG. 1 is a perspective view showing two containers according to the invention in a stacked arrangement with a third container being placed on top of the stack by a forklift truck.
Figure 2:
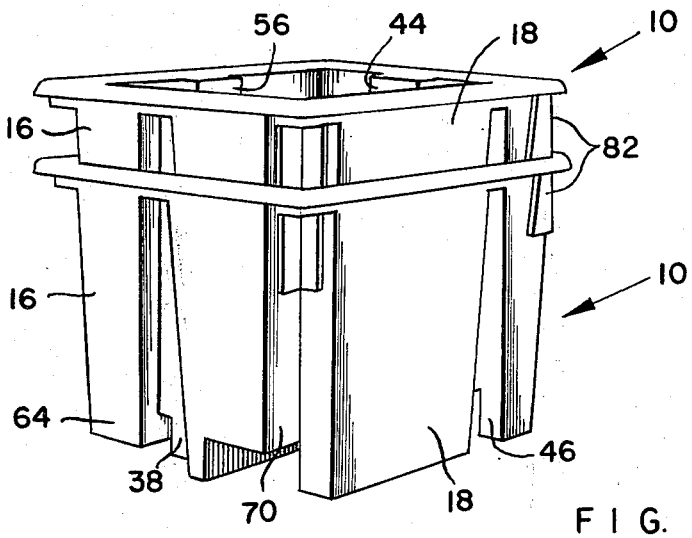
FIG. 2 is a perspective view showing two containers in a nested arrangement.

There is illustrated in FIGS. 1–8 a unitary seamless molded plastic liquid-tight container 10 having a bottom 12 and four upwardly extending walls 14, 16, 18 and 20. The term "plastic" is used herein in its most common sense, and refers to synthetic resins which are moldable into various forms and are hardened for commercial use.

For convenience of illustration and description, the walls of the container will be considered from the point of view of one standing in the container, the wall 14 thus being the front wall, the wall 16 the rear wall, the wall 18 the right side wall, and the wall 20 the left side wall.

In the bottom 12 of the container 10, there are formed five spaced, downwardly extending hollow ridges or legs 22, 24, 26, 28 and 30. The bottoms of all of these legs are coplanar so that all of them can rest simultaneously on a flat floor to support the container. These legs also form supporting members for the container 10 when stacked one upon another similar container.

Figure 4:
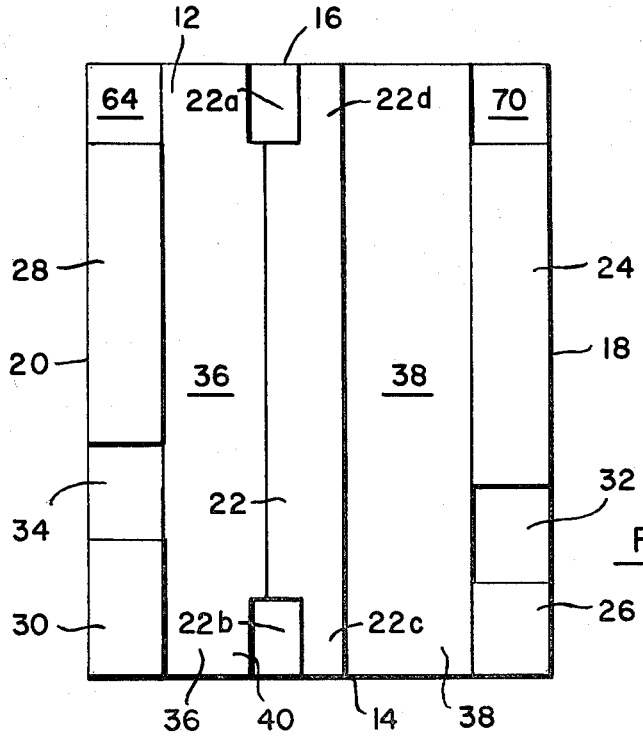
FIG. 4 is a bottom plan view of the container.

As seen in FIG. 4, center leg 22 extends, slightly off center toward the left wall 20 of the container 10, the full distance from the front wall 14 to the rear wall 16 thereof. Right rear leg 24 extends along the right wall 18 of container 10 for a substantial part, in excess of half, of the distance between the rear wall 16 and the front wall 14. Right front leg 26 extends for a portion only of the distance from the front wall 14 of the container 10 toward right rear leg 24, being in alignment therewith, whereby a space or gap 32 is provided between legs 24 and 26. Left rear leg 28 and left front leg 30 similarly extend in aligned manner along the left wall 20 of the container 10, with a space or gap 34 between them, the leg 28, however, being somewhat shorter than leg 24, and the leg 30 somewhat longer than the leg 26. As a result the gap 32 is somewhat closer to the front side 14 of the container than the gap 34 so that the gaps 32 and 34 do not coincide when an upper container is stacked on a lower container.

The center leg 22 and the aligned pairs of right legs 24, 26 and left legs 28, 30 form between them generally rectangular spaces or channels 36 and 38 for the entry of the tines of a forklift or pallet jack. The tines can enter the channels 36 and 38 from either the front 14 or the rear 16 of the container 10 with equal facility.

The upwardly extending walls 14, 16, 18 and 20 are typically five-sixteenths (5/16") of an inch (0.79 cm) in thickness for durability. Additionally, all four walls 14, 16, 18 and 20 slope slightly outwardly from bottom to top for facilitating nesting of a plurality of empty containers 10 for storage or transportation. Preferably, a taper of one and one-half (1½") inches (3.81 cm) is used on all vertical lengths exceeding twelve (12") inches (30.48 cm) to aid in the nesting and unnesting capabilities.

Figure 5:
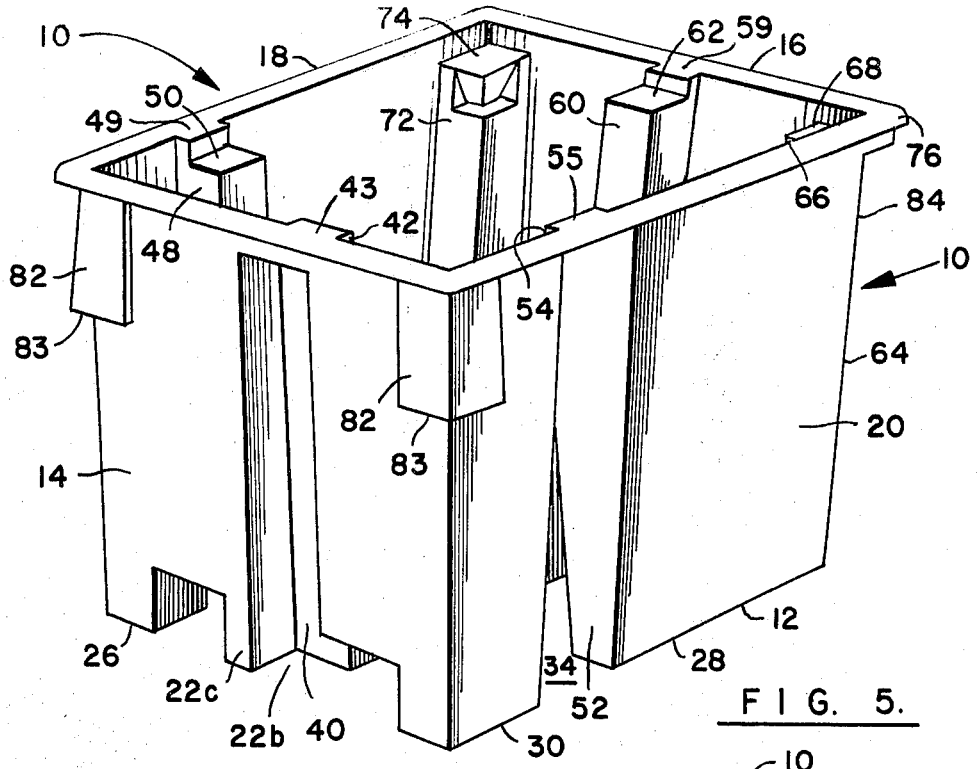
FIG. 5 is a perspective view of the container on a scale larger than that of FIG. 1 showing the front and left sides of the container.
Figure 6:
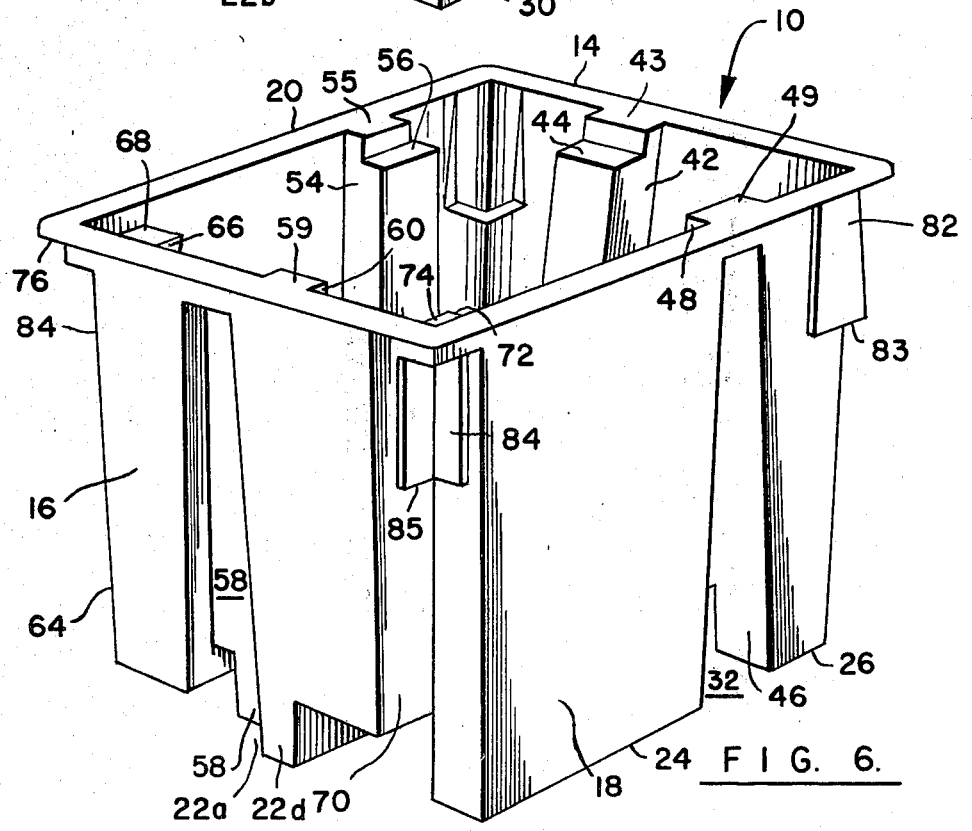
FIG. 6 is a perspective view similar to that of FIG. 5 showing the rear and right sides of the container.
Figure 7:
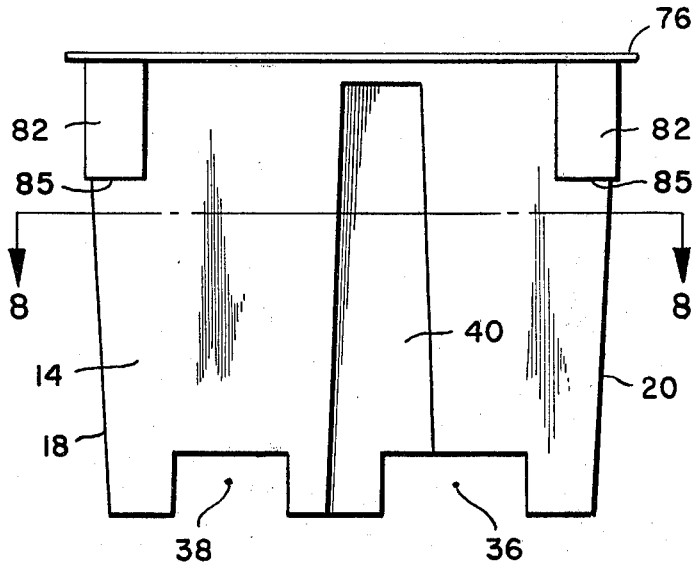
FIG. 7 is a front view of the container.
Figure 8:
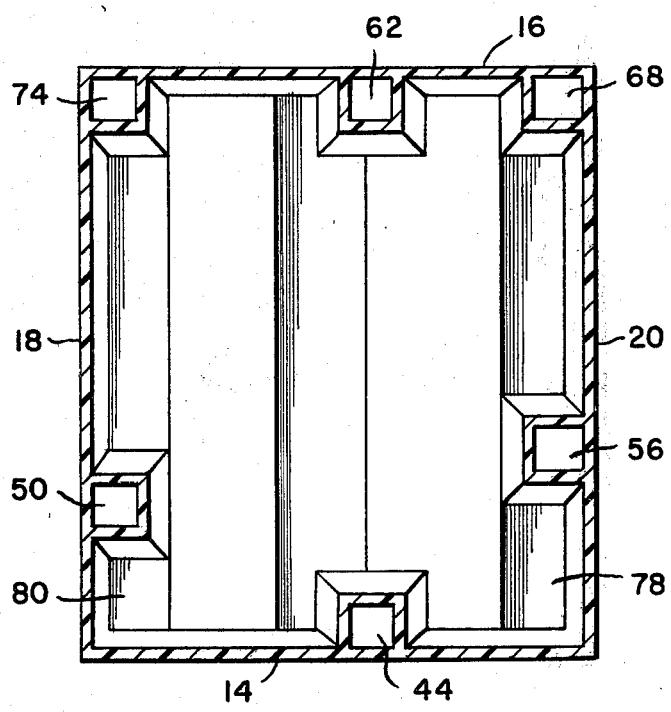
FIG. 8 is a cross-sectional view of the container taken along the lines 8—8 of FIG. 7.

As seen particularly in FIGS. 5 and 6 of the drawings, the container 10 is molded with flutes or depressions in the upwardly extending walls 14, 16, 18 and 20. These depressions are provided in accordance with the invention, in order to form stacking lugs having stacking surfaces for supporting the containers 10 one on top of another.

In accordance with the invention the stacking lugs with stacking surfaces are so formed and positioned that when a plurality of containers 10 are placed in alignment one on top of another with front walls of adjacent upper and lower containers facing in opposite directions, the legs 22, 24, 26, 28 and 30 of the upper container contact and rest on the stacking surfaces of the stacking lugs of the lower container, whereby such lower container provides the desired support for the immediately adjacent upper container.

With upper and lower containers 10 positioned with their front walls 14 facing in the same direction, the containers 10 readily fit one within another in nesting relation and so take up less space when empty and nested while in storage or while being transported.

Specifically, by reference to FIGS. 5 and 6, it is seen that there is provided a front wall depression 40 in the front wall 14 of the container 10. This depression 40 forms interiorly of the container 10, on the front wall 14, a stacking lug 42 having a flat surface 43 extending inwardly one-half inch from the top lip of container 10 and a stacking surface 44 positioned 2 inches below flat surface 43.

In the right wall 18, as seen in FIGS. 5 and 6, there is provided a right wall depression 46 that is in alignment with the gap 32, as seen in FIG. 4. This depression 46 forms interiorly of the container 10 a stacking lug 48 with a flat surface 49 extending inwardly one-half inch from the top lip of container 10 and a stacking surface 50 positioned 2 inches below flat surface 49.

In the left wall 20 there is provided a left wall depression 52 which is in alignment with the gap 34 between legs 28 and 30 which forms interiorly of the container 10 a stacking lug 54 having a flat surface 55 extending one-half inch from the top lip of the container, and a stacking surface 56 positioned 2 inches below flat surface 55.

Somewhat off center of the rear wall 16 of the container, toward the left side wall 20, is a rear wall depression 58 that forms interiorly of the container a stacking lug 60 with a flat surface 59 extending inwardly one-half inch from the top lip of container 10, and a stacking surface 62 positioned 2 inches below flat surface 59.

Stacking surfaces 44, 50, 56 and 62 are designed to support the legs of an upper stacked container 10, and flat surface 43, 49, 55 and 59 are designed to prevent the legs of the upper stacked container from shifting off the stacking surfaces.

At the left rear corner of rear wall 16 and left wall 20 there is a depression 64 that forms interiorly of the container a stacking lug 66 having a stacking surface 68. At the right rear corner of right wall 18 and the rear wall 16, there is provided a depression 70 that forms interiorly of the container a stacking lug 72 and a stacking surface 74.

For facilitating nesting of containers 10, each of the depressions 40, 46, 52, 58, 64 and 70 are tapered in a vertical direction in the same manner described above for the front and rear walls and the side walls of the container.

Figure 3:
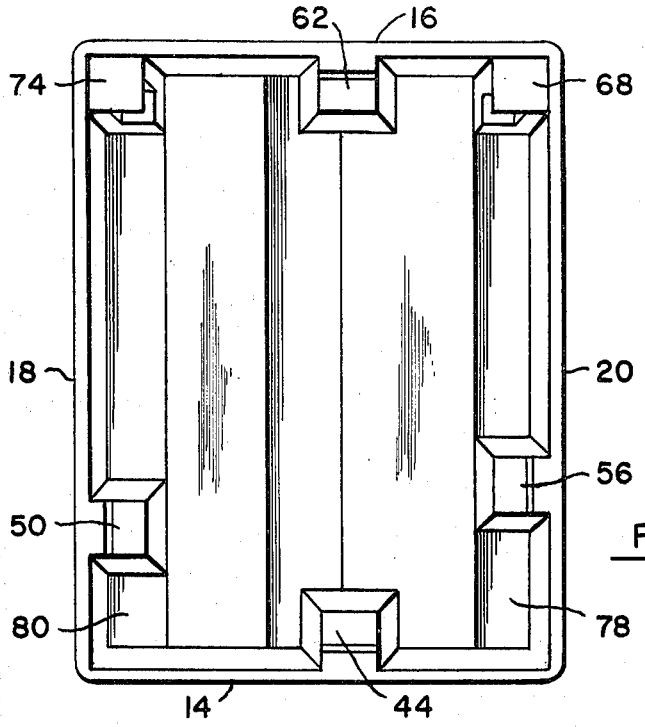
FIG. 3 is a top plan view of the container according to the invention.

As is shown in FIGS. 3, 5 and 6, the right wall depression 46, stacking lug 48 and stacking surface 50 in the right wall 18 are somewhat closer to the front wall 14 of the container than are the left wall depression 52, stacking lug 54 and stacking surface 56 in the left wall 18 so that the stacking surfaces 50 and 56 are offset for stacking and do not nest when the front wall of an upper container is placed over the rear wall of a lower container, for example. Right wall depression 46 is aligned with and forms gap 32 between the spaced right legs 24 and 26, and the left wall depression 52 is aligned with and forms gap 34 between the spaced left legs 28 and 30.

In the preferred embodiment of the invention, the stacking surfaces 44, 50, 56, 62, 68 and 74 are each 4½" (11.43 cm) square, and surfaces 44, 50, 56 and 62 are spaced inwardly a distance of about 2¾" (6.99 cm) from the peripheral edge of the container, with each of the stacking surfaces being positioned in the same plane of distance of 2" (5.08 cm) below the upper edge of the container. At the upper edge of the container there is provided a rollover lip 76 which is 1¾" wide for strength.

When a first or upper container 10 is placed on top of a second or lower container 10 with the front walls 14 of the containers facing in the same direction, the right wall gap 32 and depression 46 in the right wall 18 of the upper container are in proper position to slide over the stacking surface 50 and stacking lug 48 of the lower container. Similarly, the left wall gap 34 and depression 52 in the left wall 20 of the upper container are in proper position. to slide over the stacking surface 56 and stacking lug 54 of the lower container. The recessed end 22*a* of the center leg 22 and the rear wall depression 58 in the rear wall of the upper container are in proper position to slide over the stacking surface 62 and the stacking lug 60 of the lower container. The recessed end 22*b* of the center leg 22 and the depression 40 of the front wall of the upper container are in proper position to slide over the stacking surface 44 and stacking lug 42 of the bottom container. Accordingly, the upper container is in proper position to slide into and nest within the bottom container, the corner stacking lugs 66 and 72 of the bottom container fitting within the depressions 64 and 70 of the upper container.

An outwardly formed front corner nesting stop 82 is provided externally of each container 10 at each front wall corner below the rollover lip 76 and extends to a nesting shoulder 83 which is 9 inches below the top of the container. Similarly, a corner nesting stop 84 having a shoulder 85 is provided externally of each container at each rear wall corner depression 64 and 70 below the rollover lip 76 and extends to a nesting shoulder 11 inches below the top of the container and 9 inches below stacking surfaces 68 and 74. Nesting stops 82 rest on lip 76 and nesting stops 84 rest on stacking surfaces 68 and 74, and limit the extent to which an upper container 10 is allowed to move into a lower container 10, thus precluding undesirable wedging of the containers. Nesting stops 82 and 84 are located on the corners of the container 10 to avoid the drifting of the nesting stops which would occur if the nesting stops were located between corners of a large polyethylene container such as container 10.

When a first or upper container 10 is placed on top of a second or lower container with the upper container rotated 180° for stacking, that is with the front walls 14 of the containers facing in opposite directions, front end 22*c* of center leg 22 of the upper container is in proper position to contact and rest on the rear wall stacking surface 62 of the lower container. Similarly, the rear end 22*d* of the center leg 22 of the upper container is in proper position to contact and rest on front wall stacking surface 44 of the lower container. Additionally, right rear leg 24 of the upper container is in proper position to contact and rest on left wall stacking surface 56 of the lower container, right front leg 26 of the upper container contacting and resting on left rear corner stacking surface 68 of the lower container. Similarly, left rear leg 28 of the upper container then is in proper position to contact and rest on right front stacking surface 50 of the lower container, left front leg 30 of the upper container contacting and resting on right rear corner stacking surface 74 of the lower container.

Thus, firm and solid support for the first, the upper, container is provided by the second, the lower, container. Moreover, the arrangement is such that the upper container fits in peripheral sealing manner a sufficient distance within the lower container effectively to close the top of the lower container. This permits the elimination of the customary lid for closing the stacked containers of the prior art, the use of a lid for stacking being unnecessary. It will be understood that the use of a lid for closing off the top of a number of stacked containers may be utilized, if desired.

The container 10 is integrally manufactured by a process such as molding of a nonporous resinous plastic of high-impact strength, such as FDA-approved polyethylene and polypropylene. Such a nonporous resinous plastic conforms with health requirements. The unique seamless structural features of the molded container permit the containers to be moved, lifted and stacked by a forklift truck or a pallet jack, and to be transported without requiring the use of a pallet and without requiring, for any of the containers, a lid for use as a stacking base. The container is further characterized in that its interior is readily accessible for cleaning by brushes and other commonly used cleaning devices.

We claim:

1. A lidless open-stacking seamless plastic container comprising, a bottom and four upwardly extending walls, said walls comprising a front wall, a rear wall, a right wall and a left wall, said bottom including five downwardly extending legs forming supporting members for the container, a center leg extending somewhat off-center between said front and rear walls, extending in end-to-end relation adjacent said right wall between said front wall and said rear wall with a right wall gap between them, front and rear left wall legs extending in end-to-end relation adjacent said left wall between said front wall and said rear wall with a left wall gap between them, said right wall gap being closer to said front wall than said left wall gap, channels formed between said center leg and said right and left wall legs, and extending between said front and rear walls for the entry of the tines of a forklift truck, and said walls including a plurality of depressions, said depressions forming stacking lugs internally of the container with a front wall stacking lug adjacent said front wall substantially centrally thereof, a right wall stacking lug adjacent said right wall, a left wall stacking lug adjacent said left wall, a rear wall stacking lug adjacent said rear wall somewhat off center thereof toward said left wall, said right wall stacking lug being closer to said front wall than said left wall stacking lug, a right rear corner stacking lug adjacent said rear wall near said right wall and a left rear corner stacking lug adjacent said rear wall near said left wall, each of said stacking lugs having an upper stacking surface, said front, rear, right and left wall stacking lugs having a flat surface extending inwardly from the top of the container and a stacking surface positioned beneath the flat surfaces, depressions in the corner formed by the rear wall and left wall and in the corner formed by the rear wall and right wall and forming rear wall corner stacking lugs with stacking surfaces, whereby with an upper container placed upright on top of a lower container with the front walls thereof facing in opposite directions the rear end of said center leg on the upper container contacts the front wall stacking surface of the lower container and the front end of said upper container center leg contacts a rear wall stacking surface of the lower container, said right wall legs of the upper container contact the left wall stacking surfaces of the lower container, and said left wall legs of the upper container contact the right wall stacking surfaces of the lower container, the lower container thereby providing support for the upper container without the need for a lid as a stacking base, and whereby with an upper container placed over a lower container with the front walls thereof facing in the same direction, the legs on the bottom of the upper container slide past the stacking surfaces and lugs of the lower container and the upper container thus nests within the lower container.

2. A lidless open stacking container as specified in claim 1 further including a rollover lip along the upper edge of said walls, and nesting stops extending outwardly from the front and rear wall corners and formed under said rollover lip externally of said container to limit the extent to which an upper container may extend into a lower container when nested therein, the front and rear wall nesting stops having shoulders which are positioned in the same horizontal plane so as to rest on the upper lip of a lower container in which the container is nested, with said rear wall nesting stops extending into the depressions forming the rear wall corner stacking lugs.

* * * * *